US012111142B2

(12) United States Patent
Xiang

(10) Patent No.: US 12,111,142 B2
(45) Date of Patent: Oct. 8, 2024

(54) HIGH-PRECISION SPHERICAL SINGLE-HEADED BULLET

(71) Applicant: Dahua Xiang, Yancheng (CN)

(72) Inventor: Dahua Xiang, Yancheng (CN)

( * ) Notice: Subject to any disclaimer, the term of this patent is extended or adjusted under 35 U.S.C. 154(b) by 0 days.

(21) Appl. No.: 17/964,817

(22) Filed: Oct. 12, 2022

(65) Prior Publication Data

US 2023/0043486 A1 Feb. 9, 2023

(30) Foreign Application Priority Data

Sep. 16, 2022 (CN) ..... 202222456153.X

(51) Int. Cl.

| | |
|---|---|
| ***F42B 7/08*** | (2006.01) |
| ***F42B 7/10*** | (2006.01) |
| *F42B 5/02* | (2006.01) |
| *F42B 5/045* | (2006.01) |

(52) U.S. Cl.

CPC ..... *F42B 7/10* (2013.01); *F42B 7/08* (2013.01); *F42B 5/02* (2013.01); *F42B 5/045* (2013.01)

(58) Field of Classification Search

CPC ..... F42B 7/00; F42B 7/02; F42B 7/08; F42B 7/10; F42B 5/02; F42B 5/025; F42B 5/045; F42B 30/02

USPC ..... 102/439, 444, 447, 448–463

See application file for complete search history.

(56) References Cited

U.S. PATENT DOCUMENTS

| | | | | |
|---|---|---|---|---|
| 3,791,303 A * | 2/1974 | Sweeney | F42B 30/04 42/105 |
| 4,471,699 A * | 9/1984 | Turco | F42B 7/10 102/501 |
| 4,676,169 A * | 6/1987 | Maki | F42B 5/02 102/501 |
| 4,895,076 A * | 1/1990 | Looger | F42B 12/40 102/513 |

(Continued)

FOREIGN PATENT DOCUMENTS

| | | |
|---|---|---|
| CN | 104608047 A | 5/2015 |
| CN | 204788076 U | 11/2015 |

(Continued)

OTHER PUBLICATIONS

Machine translation of FR-2615936 -A1 (Year: 1988).*
Machine translation of CN 219531835 U (Year: 2023).*

*Primary Examiner* — James S Bergin
(74) *Attorney, Agent, or Firm* — Jeenam Park

(57) ABSTRACT

The present invention provides a high-precision spherical single-headed bullet, including a spherical warhead, a circular cylindrical bullet support and a cardboard bullet support which are arranged in a smoothbore tube; an inner cavity of the smoothbore tube is filled with a propellant; the cardboard bullet support is arranged above the propellant at the rear end of the smoothbore tube in a closed manner; one end of the cardboard bullet support away from the propellant is provided with the circular cylindrical bullet support; an inner cavity of the circular cylindrical bullet support is provided with a firing hole; and the spherical warhead is arranged at the upper end of the firing hole of the circular cylindrical bullet support. According to the present invention, the spherical warhead has natural relative stability in flight, higher shooting accuracy and strong penetrating power, and is low in price and easy to process.

3 Claims, 3 Drawing Sheets

(56) References Cited

U.S. PATENT DOCUMENTS

| | | | | | |
|---|---|---|---|---|---|
| 4,947,752 | A * | 8/1990 | Richert | F42B 5/02 | 102/447 |
| 5,361,700 | A * | 11/1994 | Carbone | F42B 7/10 | 102/513 |
| 6,371,028 | B2 * | 4/2002 | Saxby | F42B 12/34 | 102/444 |
| 11,009,321 | B2 * | 5/2021 | Buys | F42B 10/06 | |

FOREIGN PATENT DOCUMENTS

| | | | | | |
|---|---|---|---|---|---|
| CN | 216385317 | U | | 4/2022 | |
| CN | 219531835 | U | * | 8/2023 | |
| FR | 2615936 | A1 | * | 12/1988 | F42B 7/10 |

* cited by examiner

HIGH-PRECISION SPHERICAL SINGLE-HEADED BULLET

CROSS-REFERENCE TO RELATED APPLICATIONS

The application claims priority to Chinese patent application No. 202222456153X, filed on Sep. 16, 2022, the entire contents of which are incorporated herein by reference.

TECHNICAL FIELD

The present invention relates to the technical field of shotgun bullets, in particular to a high-precision spherical single-headed bullet.

BACKGROUND

A shotgun is a musket with no rifling in the barrel, and a warhead fired does not rotate. The warhead of the shotgun consists of several to hundreds of small spherical projectiles. The chamber pressure of the shotgun bullet is low, the overall warhead of the shotgun is heavy, the muzzle velocity is not high, and the small projectiles scattered after exiting the chamber have limited velocity storage capacity, with the end trajectory only about 100 meters, and the effective distance about 50 meters.

To improve the power and effective shooting distance of the shotgun, a variety of single-headed bullets for shotguns are developed, with various shapes of warheads from a spherical shape to a cylindrical shape with a spherical tip, a cylindrical shape with a pointed tip, and a cylindrical shape with a spiral angle tail tip. The bullets with such shapes have large air resistance in flight. The micro-rotation generated when a warhead flies is also achieved by increasing the forward resistance of the warhead. These warhead shapes have strong eddy currents at tail ends during flight, which affects the velocity storage ability of the warhead, affects the flight distance and reduces the firing dispersion extent. Existing warheads are generally made of lead alloy materials, which are not environmentally friendly and have limited armor-piercing capability.

The existing commonly-used warheads include foster warheads that are hollow and poor in penetrating power, brenneke warheads that fly out with bullet support to obtain a low speed, and sabot warheads that require spiral rifled barrels for firing, so that the bullets are expensive.

There is a need for a novel warhead with high firing precision, strong penetrating power and low cost, which can solve the problems mentioned above.

SUMMARY

The present invention provides a high-precision spherical single-headed bullet, which solves the problems of high cost and low precision of the existing bullets by technically transforming the existing bullets.

To achieve the above-mentioned purpose, the technical solution adopted in the present invention is:

A high-precision spherical single-headed bullet, including a spherical warhead, a circular cylindrical bullet support and a cardboard bullet support, where the spherical warhead, the circular cylindrical bullet support and the cardboard bullet support are arranged in a smoothbore tube; a primer is arranged at the bottom end of the smoothbore tube; an inner cavity of the smoothbore tube above the primer is filled with a propellant; the cardboard bullet support is arranged above the propellant at the rear end of the smoothbore tube in a closed manner; one end of the cardboard bullet support away from the propellant is provided with the circular cylindrical bullet support; an inner cavity of the circular cylindrical bullet support is provided with a firing hole; and the spherical warhead is arranged at the upper end of the firing hole of the circular cylindrical bullet support.

Preferably, the diameter of the outer side surface of the circular cylindrical bullet support is consistent with the inner diameter of the smoothbore tube.

Preferably, the diameter of the spherical warhead is smaller than the inner diameter of the smoothbore tube.

Preferably, the outer side surface of the circular cylindrical bullet support is provided with vertical ridges uniformly arranged at intervals, and the vertical ridges are abutted against the inner wall of the smoothbore tube.

Preferably, an arc-shaped curved surface is arranged on a contact surface between the firing hole of the inner cavity of the circular cylindrical bullet support and the spherical warhead.

Preferably, the contact surfaces of the cardboard bullet support and the circular cylindrical bullet support are fixedly connected into a whole.

Preferably, the cardboard bullet support and the circular cylindrical bullet support are arranged independent of each other, a limit component is arranged at the contact surface of the cardboard bullet support and the circular cylindrical bullet support, and the cardboard bullet support and the circular cylindrical bullet support are connected via the limit component in a clamped manner.

Preferably, the limit component includes a clamp slot and a protruding part; an end surface of the cardboard bullet support relative to the circular cylindrical bullet support is provided with the clamp slot; the bottom surface of the circular cylindrical bullet support is provided with the protruding part; and the protruding part and the clamp slot are clamped with each other.

The beneficial effects of the present invention are:

1. The precision is higher. According to the present invention, a spherical warhead structure is used, and a spherical warhead has natural relative stability in flight and high firing precision. When the warhead moves in the barrel, as the diameter of the circular cylindrical bullet support is the same as the inner diameter of the barrel, the acceleration of gunpowder can firmly clamp the warhead at the hole of the circular cylindrical bullet support temporarily, thereby ensuring that the motion trajectory of the spherical warhead is parallel to the barrel when in the barrel and further ensuring the firing precision. The cardboard bullet support can be used to prevent high temperature gas from burning and deforming the cylindrical bullet support, which affects the smooth movement of the cylindrical bullet support and further affects the precision of the warhead.
2. The penetrating power is strong. According to the present invention, the warhead can use a steel ball warhead to ensure the penetrating performance of firing, and spherical warheads of various materials such as steel balls, lead and rubber can be used to meet the usage needs of different scenarios.
3. The price is cheap. According to the present invention, the warhead and the bullet support are easy to process, and can be produced by a slight change in the original production line without any complicated part and structure.

Figure 1:
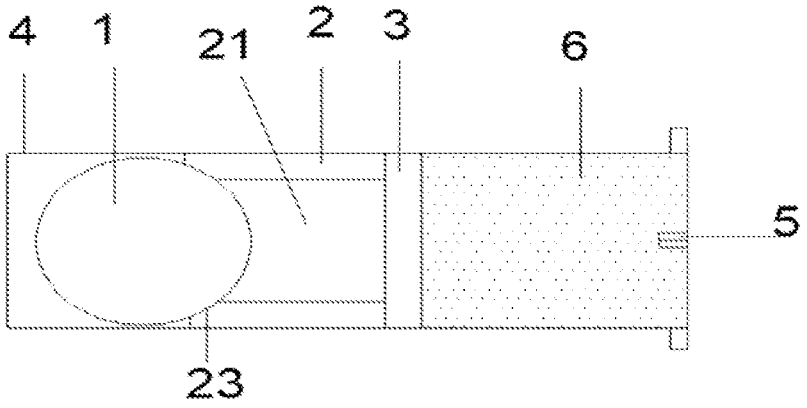
FIG. 1 is a structural diagram of the present invention.

Description of reference numerals: Spherical Warhead 1, Circular Cylindrical Bullet Support 2, Firing Hole 21, Vertical Ridge 22, Arc-shaped Curved Surface 23, Cardboard Bullet Support 3, Smoothbore Tube 4, Primer 5. Propellant 6, Limit Component 7, Clamp Slot 71, and Protruding Part 72.

DETAILED DESCRIPTION

The specific content of the present invention will be described in detail below with reference to the drawings and embodiments.

Figure 2:
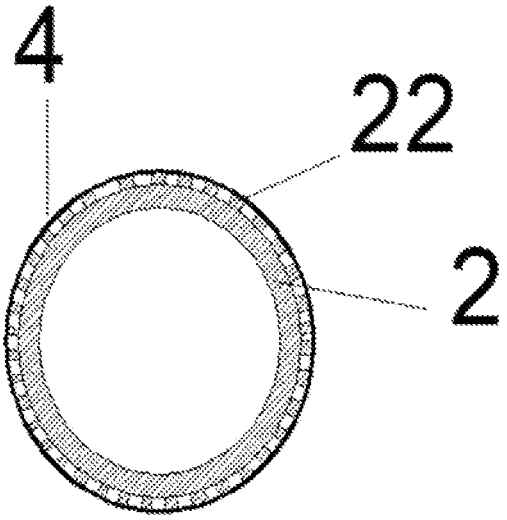
FIG. 2 is a schematic diagram of vertical ridges according to the present invention.
Figure 3:
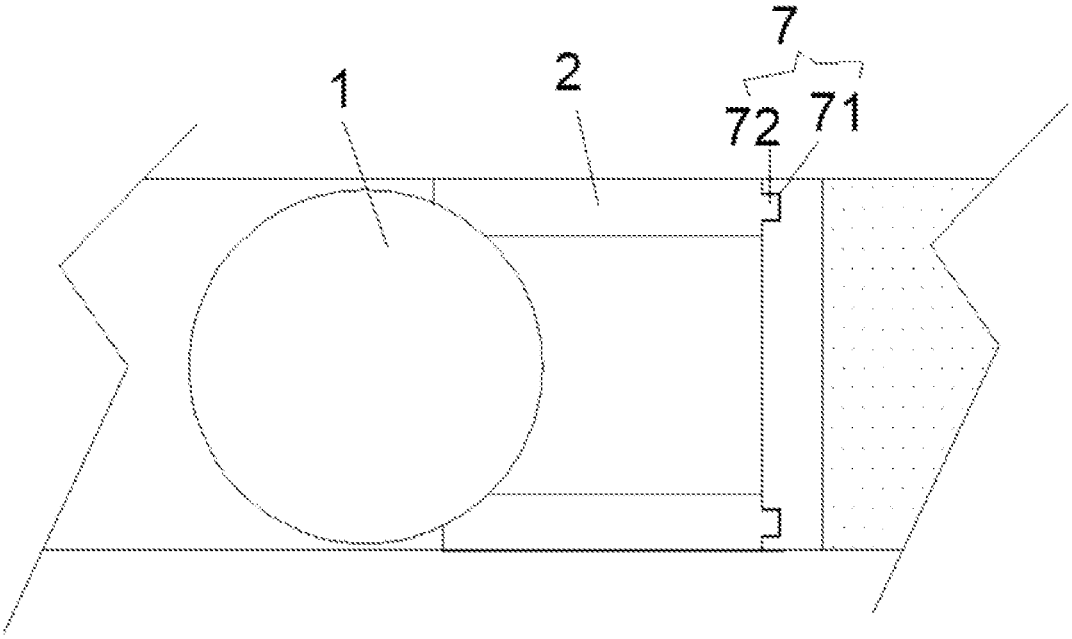
FIG. 3 is a schematic diagram of installation of the limit component according to the present invention.

As shown in FIGS. 1-3, the present invention provides a high-precision spherical single-headed bullet, including a spherical warhead 1, a circular cylindrical bullet support 2 and a cardboard bullet support 3, where the spherical warhead 1, the circular cylindrical bullet support 2 and the cardboard bullet support 3 are arranged in a smoothbore tube 4; a primer 5 is arranged at the bottom end of the smoothbore tube 4; an inner cavity of the smoothbore tube 4 above the primer 5 is filled with a propellant 6; the cardboard bullet support 3 is arranged above the propellant 6 at the rear end of the smoothbore tube 4 in a closed manner; one end of the cardboard bullet support 3 away from the propellant 6 is provided with the circular cylindrical bullet support 2; an inner cavity of the circular cylindrical bullet support 2 is provided with a firing hole 21; and the spherical warhead 1 is arranged at the upper end of the firing hole 21 of the circular cylindrical bullet support 2. The cardboard bullet support 3 can be used to prevent high temperature gas from burning and deforming the cylindrical bullet support, which affects the smooth movement of the cylindrical bullet support and further affects the precision of the warhead.

Further, to ensure that the flight direction when pushing the bullet support is consistent with the smoothbore tube 4, the diameter of the outer side surface of the circular cylindrical bullet support 2 is consistent with the inner diameter of the smoothbore tube 4.

Further, to ensure the movement effect of the spherical warhead 1, the diameter of the spherical warhead 1 is slightly smaller than the inner diameter of the smoothbore tube 4.

Further, to reduce the friction between the bullet support and the barrel, the outer side surface of the circular cylindrical bullet support 2 is provided with vertical ridges 22 uniformly arranged at intervals, and the vertical ridges 22 are abutted against the inner wall of the smoothbore tube 4.

Further, to ensure a more stable pushing effect to ensure the flight stability of the spherical warhead 1, an arc-shaped curved surface 23 is arranged on a contact surface between the firing hole 21 of the inner cavity of the circular cylindrical bullet support 2 and the spherical warhead 1.

Further, the contact surfaces of the cardboard bullet support 3 and the circular cylindrical bullet support 2 are fixedly connected into a whole.

Further, in another embodiment 2, the cardboard bullet support 3 and the circular cylindrical bullet support 2 are arranged independent of each other, a limit component 7 is arranged at the contact surface of the cardboard bullet support 3 and the circular cylindrical bullet support 2, and the cardboard bullet support 3 and the circular cylindrical bullet support 2 are connected via the limit component 7 in a clamped manner.

Further, to ensure the positioning effect of the limit component 7, the limit component 7 includes a clamp slot 71 and a protruding part 72; an end surface of the cardboard bullet support 3 relative to the circular cylindrical bullet support 2 is provided with the clamp slot 71; the bottom surface of the circular cylindrical bullet support 2 is provided with the protruding part 72; and the protruding part 72 and the clamp slot 71 are clamped with each other.

The use process of the single-headed bullet of the present invention includes the following steps:

S1, hitting the primer 5;

S2, igniting the propellant 6;

S3, pushing the cardboard bullet support 3, the circular cylindrical bullet support 2, and the spherical warhead to advance in the barrel; and S4, making the spherical warhead detach from the barrel at high speed and stably to fly to a target, the circular cylindrical bullet support 2 and the cardboard bullet support 3 to quickly separate and fall to the ground under the influence of air resistance.

The present invention has the following characteristics:

1. The precision is higher. According to the present invention, a spherical warhead structure is used, and the spherical warhead 1 has natural relative stability in flight and high firing precision. When the warhead moves in the barrel, as the diameter of the circular cylindrical bullet support is the same as the inner diameter of the barrel, the acceleration of gunpowder can firmly clamp the warhead at the hole of the circular cylindrical bullet support temporarily, thereby ensuring that the motion trajectory of the spherical warhead is parallel to the barrel when in the barrel and further ensuring the firing precision. The cardboard bullet support 3 can be used to prevent high temperature gas from burning and deforming the cylindrical bullet support, which affects the smooth movement of the cylindrical bullet support and further affects the precision of the warhead.
2. The penetrating power is strong. According to the present invention, the warhead can use a steel ball warhead to ensure the penetrating performance of firing, and spherical warheads of various materials such as steel balls, lead and rubber can be used to meet the usage needs of different scenarios.
3. The price is cheap. According to the present invention, the warhead and the bullet support are easy to process, can be produced by a slight change in the original production line without any complicated part and structure.

Finally, it should be noted that the above-mentioned embodiments are only used for describing, rather than limiting the technical solution of the present invention. Although the present invention is described in detail with reference to the preferred embodiments, those ordinary skilled in the art shall understand that the technical solution of the present invention can be amended or equivalently replaced without departing from the purpose and the scope of the technical solution of the present invention. The amendment or equivalent replacement shall be covered within the scope of the claims of the present invention.

All the standard parts used in the present invention are commercially available, and special-shaped parts can be customized according to the record of the description and the drawings. Concrete connection modes of various parts adopt conventional means such as bolts, rivets and welding which are mature in the prior art; machinery, parts and equipment are of conventional models in the prior art; and circuits are connected in conventional connection modes in the prior art, which are not described in detail herein.

In the description of the present invention, unless otherwise specifically regulated and defined, terms such as "installation", "connected", "connecting" and "fixation" shall be understood in broad sense, which, for example, may refer to fixed connection or detachable connection or integral connection, may refer to mechanical connection or electrical connection, and may refer to direct connection or connection via an intermediate medium or inner communication of two elements or interaction relationship of two elements. For those skilled in the art, the specific meanings of the above-mentioned terms in the present invention may be understood according to specific conditions.

What is claimed is:

1. A high-precision spherical single-headed bullet, comprising a spherical warhead, a cylindrical bullet support with a ring cross-section and a cardboard bullet support, wherein the spherical warhead, the cylindrical bullet support and the cardboard bullet support are arranged in a smoothbore tube; a primer is arranged at a bottom end of the smoothbore tube; an inner cavity of the smoothbore tube above the primer is filled with a propellant; the cardboard bullet support is arranged in the inner cavity of the smoothbore tube above the propellant and seals against an inner wall of the smoothbore tube; one end surface of the cardboard bullet support facing away from the propellant is attached to the cylindrical bullet support; an inner cavity of the cylindrical bullet support is formed as a firing hole; and the spherical warhead is arranged at an upper end of the firing hole of the cylindrical bullet support;

wherein a diameter of the spherical warhead is smaller than an inner diameter of the smoothbore tube; wherein an arc-shaped curved surface is arranged on a front end surface of the cylindrical bullet support, and the arc-shaped curved surface is fitted to an outer surface of the spherical warhead to clamp and hold the spherical warhead;

wherein an outer side surface of the cylindrical bullet support is provided with vertical ridges uniformly arranged at intervals and parallel to the longitudinal axis of the cylindrical bullet support, and the vertical ridges are abutted against the inner wall of the smoothbore tube.

2. The high-precision spherical single-headed bullet according to claim 1, wherein the cardboard bullet support and the cylindrical bullet support are separate components, a limit component is arranged at a contact surface of the cardboard bullet support and the cylindrical bullet support, and the cardboard bullet support and the cylindrical bullet support are connected via the limit component in a clamped manner.

3. The high-precision spherical single-headed bullet according to claim 2, wherein the limit component comprises a clamp slot and a protruding part; an end surface of the cardboard bullet support facing the cylindrical bullet support is provided with the clamp slot; a bottom surface of the cylindrical bullet support is provided with the protruding part; and the protruding part and the clamp slot are clamped with each other.

* * * * *